US011866877B2

(12) United States Patent
Carpenter et al.

(10) Patent No.: US 11,866,877 B2
(45) **Date of Patent: *Jan. 9, 2024**

(54) LAUNDRY TREATING APPLIANCE HAVING A STAIN TREATING STATION

(71) Applicant: WHIRLPOOL CORPORATION, Benton Harbor, MI (US)

(72) Inventors: Scott E. Carpenter, Wanatah, IN (US); Bruno T. Ramasco, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 38 days.

This patent is subject to a terminal disclaimer.

(21) Appl. No.: 17/481,893

(22) Filed: Sep. 22, 2021

(65) Prior Publication Data

US 2022/0010476 A1 Jan. 13, 2022

Related U.S. Application Data

(63) Continuation of application No. 16/176,850, filed on Oct. 31, 2018, now Pat. No. 11,155,952.

(51) Int. Cl.

| | |
|---|---|
| ***D06F 39/02*** | (2006.01) |
| ***D06F 23/04*** | (2006.01) |
| ***D06F 35/00*** | (2006.01) |
| ***D06F 29/00*** | (2006.01) |

(52) U.S. Cl.

CPC ..... *D06F 39/028* (2013.01); *D06F 23/04* (2013.01); *D06F 29/00* (2013.01); *D06F 35/00* (2013.01); *D06F 39/022* (2013.01)

(58) Field of Classification Search

CPC ... D06F 3/00; D06F 3/02; D06F 21/06; D06F 21/08; D06F 23/04; D06F 29/00; D06F 33/37; D06F 33/57; D06F 35/00; D06F 39/022; D06F 39/028; D06F 39/088; D06F 43/002

See application file for complete search history.

(56) References Cited

U.S. PATENT DOCUMENTS

| | | | | |
|---|---|---|---|---|
| 3,490,254 | A | 1/1970 | Mason | |
| 7,814,768 | B2 | 10/2010 | Vecchi et al. | |
| 9,200,399 | B2 | 12/2015 | Kim et al. | |
| 9,217,215 | B2 | 12/2015 | Kim et al. | |
| 9,702,077 | B2 | 7/2017 | Doh | |
| 10,233,587 | B2 | 3/2019 | Carpenter | |
| 2013/0340178 | A1 | 12/2013 | Riesenberg et al. | |
| 2015/0247276 | A1 | 9/2015 | Kim et al. | |
| 2016/0138207 | A1* | 5/2016 | Del Pos | D06F 34/28 68/17 R |
| 2016/0326685 | A1 | 11/2016 | Pollett | |
| 2016/0348293 | A1 | 12/2016 | Kawaguchi et al. | |
| 2017/0037558 | A1 | 2/2017 | Dunsbergen et al. | |

(Continued)

FOREIGN PATENT DOCUMENTS

KR 20170027175 A 3/2017

*Primary Examiner* — David G Cormier
(74) *Attorney, Agent, or Firm* — McGarry Bair PC

(57) ABSTRACT

A laundry treating appliance includes a chassis defining an interior. A rotatable treating chamber is located within the interior. The laundry treating appliance further includes a dispenser fluidly coupled to the treating chamber. A stain treating station is carried by the chassis at a location spaced from the dispenser.

18 Claims, 6 Drawing Sheets

(56) References Cited

U.S. PATENT DOCUMENTS

| | | | | |
|---|---|---|---|---|
| 2017/0037559 | A1 | 2/2017 | Gallagher et al. | |
| 2017/0268151 | A1 | 9/2017 | Leibman et al. | |
| 2018/0245264 | A1 | 8/2018 | Beres et al. | |
| 2018/0245265 | A1 | 8/2018 | Beres et al. | |
| 2019/0136439 | A1* | 5/2019 | Cooke | G07F 13/10 |
| 2019/0169782 | A1 | 6/2019 | Leibman | |
| 2019/0234001 | A1 | 8/2019 | Gallagher et al. | |

* cited by examiner

LAUNDRY TREATING APPLIANCE HAVING A STAIN TREATING STATION

CROSS-REFERENCE TO RELATED APPLICATIONS

The present application is a continuation application of U.S. patent application Ser. No. 16/176,850 filed on Oct. 31, 2018, now U.S. Pat. No. 11,155,952, issued Oct. 26, 2021, and which is hereby incorporated herein by reference in its entirety.

BACKGROUND

Laundry treating appliances, such as washing machines, refreshers, and non-aqueous systems, can have a configuration based on a rotating container that at least partially defines a treating chamber in which laundry items are placed for treating. The laundry treating appliance can have a controller that implements a number of user-selectable, pre-programmed cycles of operation. Hot water, cold water, or a mixture thereof along with various treating chemistries, or detergents, can be supplied to the treating chamber in accordance with the cycle of operation. In vertical or horizontal axis washing machines a detergent dispenser can be in the form of a drawer fluidly coupled to the treating chamber to receive a volume of detergent to treat the laundry items according to the cycle of operation. The drawer usually includes containers for treating chemistries such as detergent or fabric softener and can supply the treating chemistries to the treating chamber via a conduit.

Laundry treating appliances typically operate to treat laundry items by placing the laundry items in contact with cleaning fluid such as soapy water, and providing relative motion between the laundry items and the fluid. Commonly, a fabric mover, such as an agitator, provides mechanical energy to a load of laundry items immersed in the cleaning fluid by agitating the laundry load in a manner that both jostles the laundry items in the fluid and circulates the fluid through the laundry items. A laundry treating appliance for home use can perform a select programmed series of operations on fabric placed in a basket or drum located within the interior of the machine. However, it can occur that none of a selection of preprogrammed wash cycles is thought by the washing machine user to be sufficient to fully remove certain stains on the fabric being laundered. The user can choose to address such stains manually before adding the stained laundry items to the laundry load.

BRIEF SUMMARY

An aspect of the present disclosure relates to a laundry treating appliance comprising a chassis defining an interior, a rotatable treating chamber located within the interior, a dispenser having at least one bulk treating reservoir fluidly coupled to the treating chamber, a stain treating station carried by the chassis at a location spaced from the dispenser, and a treating chemistry bottle fluidly coupled to the stain treating station.

Another aspect of the present disclosure relates to a laundry treating appliance comprising a chassis defining an interior, a rotatable treating chamber located within the interior and rotatable about a generally vertical axis and having an access opening, a shroud connected to the chassis and located above the access opening, a dispenser located in the shroud and fluidly coupled to the treating chamber, a stain treating station located in the shroud along a front of the chassis and spaced from the dispenser, a treating chemistry bottle fluidly coupled to the stain treating station, and a lid hingedly mounted to the chassis for movement between an opened and closed position, with the lid overlying the stain treating station in the closed position.

DETAILED DESCRIPTION OF THE DISCLOSURE

Figure 1:
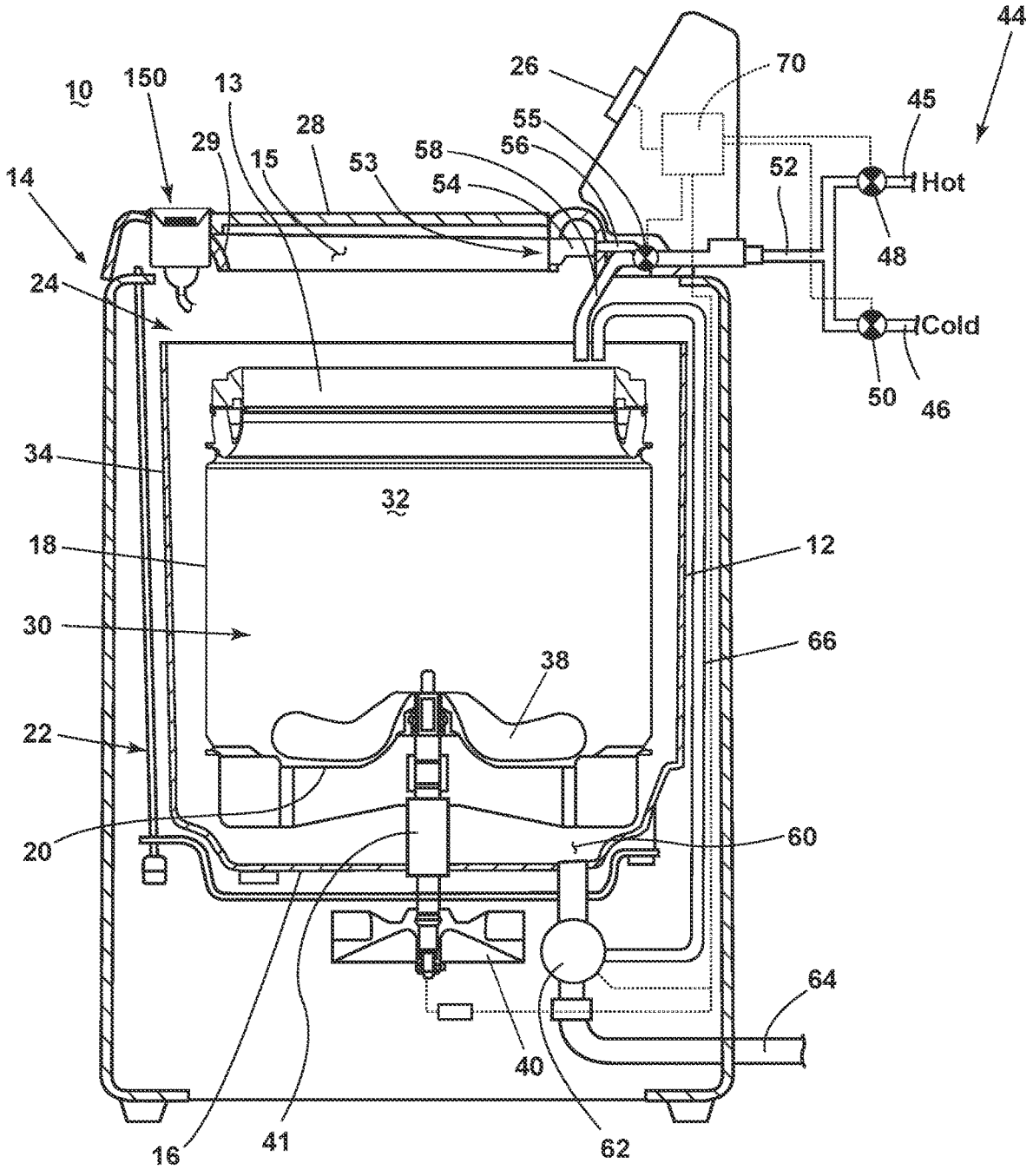
FIG. 1 is a schematic cross-sectional view of a laundry treating appliance in the form of a washing machine including a dispenser according to an aspect of the present disclosure.

FIG. 1 is a schematic view of a laundry treating appliance according to aspects of the present disclosure. The laundry treating appliance can be any appliance which performs a cycle of operation to clean or otherwise treat items placed therein, non-limiting examples of which include a horizontal or vertical axis clothes washer; a clothes dryer; a combination washing machine and dryer; a dispensing dryer; a tumbling or stationary refreshing/revitalizing machine; an extractor; a non-aqueous washing apparatus; and a revitalizing machine. While the laundry treating appliance of FIG. 1 is illustrated as a vertical axis, top-load laundry treating appliance, the aspects of the present disclosure can have applicability in laundry treating appliances with other configurations.

Washing machines are typically categorized as either a vertical axis washing machine or a horizontal axis washing machine. As used herein, the term "horizontal axis" washing machine refers to a washing machine having a rotatable drum that rotates about a generally horizontal axis relative to a surface that supports the washing machine. The drum can rotate about the axis inclined relative to the horizontal axis, with fifteen degrees of inclination being one example of the inclination. Similar to the horizontal axis washing machine, the term "vertical axis" washing machine refers to a washing machine having a rotatable drum that rotates about a generally vertical axis relative to a surface that supports the washing machine. However, the rotational axis need not be perfectly vertical to the surface. The drum can rotate about an axis inclined relative to the vertical axis, with fifteen degrees of inclination being one example of the inclination.

In another aspect, the terms vertical axis and horizontal axis are often used as shorthand terms for the manner in which the appliance imparts mechanical energy to the laundry, even when the relevant rotational axis is not absolutely vertical or horizontal. As used herein, the "vertical axis" washing machine refers to a washing machine having a rotatable drum, perforate or imperforate, that holds fabric items and a clothes mover, such as an agitator, impeller, nutator, and the like within the drum. The clothes mover moves within the drum to impart mechanical energy directly to the clothes or indirectly through wash liquid in the drum. The clothes mover may typically be moved in a reciprocating rotational movement. In some vertical axis washing machines, the drum rotates about a vertical axis generally perpendicular to a surface that supports the washing machine. However, the rotational axis need not be vertical. The drum may rotate about an axis inclined relative to the vertical axis.

As used herein, the "horizontal axis" washing machine refers to a washing machine having a rotatable drum, perforated or imperforate, that holds laundry items and washes the laundry items. In some horizontal axis washing machines, the drum rotates about a horizontal axis generally parallel to a surface that supports the washing machine. However, the rotational axis need not be horizontal. The drum can rotate about an axis inclined or declined relative to the horizontal axis. In horizontal axis washing machines, the clothes are lifted by the rotating drum and then fall in response to gravity to form a tumbling action. Mechanical energy is imparted to the clothes by the tumbling action formed by the repeated lifting and dropping of the clothes. Vertical axis and horizontal axis machines are best differentiated by the manner in which they impart mechanical energy to the fabric articles.

Regardless of the axis of rotation, a washing machine can be top-loading or front-loading. In a top-loading washing machine, laundry items are placed into the drum through an access opening in the top of a cabinet, while in a front-loading washing machine laundry items are placed into the drum through an access opening in the front of a cabinet. If a washing machine is a top-loading horizontal axis washing machine or a front-loading vertical axis washing machine, an additional access opening is located on the drum.

The laundry treating appliance of FIG. 1 is illustrated as a vertical-axis washing machine 10, which can include a structural support system including a cabinet 14, which defines a housing within which a laundry holding system resides. The cabinet 14 can be a housing having a chassis and/or a frame, to which decorative panels can or cannot be mounted, defining an interior enclosing components typically found in a conventional washing machine, such as motors, pumps, fluid lines, controls, sensors, transducers, and the like. Such components will not be described further herein except as necessary for a complete understanding of the present disclosure.

The laundry holding system of the illustrated exemplary washing machine 10 can include a rotatable basket 30 having an open top 13 that can be disposed within the interior of the cabinet 14 and can define a rotatable treating chamber 32 for receiving laundry items for treatment and an access opening 15 to the treating chamber 32. The basket 30 is configured to receive a laundry load comprising articles for treatment, including, but not limited to, a hat, a scarf, a glove, a sweater, a blouse, a shirt, a pair of shorts, a dress, a sock, and a pair of pants, a shoe, an undergarment, and a jacket. The open top can be aligned with the access opening 15. A tub 34 can also be positioned within the cabinet 14 and can define an interior 24 within which the basket 30 can be positioned. The tub 34 can have a generally cylindrical side or tub peripheral wall 12 closed at its bottom end by a base 16 that can at least partially define a sump 60.

The basket 30 can have a generally peripheral side wall 18, which is illustrated as a cylindrical side wall, closed at the basket end by a basket base 20 to at least partially define the treating chamber 32. The basket 30 can be rotatably mounted within the tub 34 for rotation about a vertical basket axis of rotation and can include a plurality of perforations, such that liquid can flow between the tub 34 and the rotatable basket 30 through the perforations. While the illustrated washing machine 10 includes both the tub 34 and the basket 30, with the basket 30 defining the treating chamber 32, it is within the scope of the present disclosure for the laundry treating appliance to include only one receptacle, with the receptacle defining the laundry treatment chamber for receiving the load to be treated.

The cabinet 14 can further define a top wall 82, which can comprise a shroud 29 or to which the shroud 29 can be coupled. The shroud 29 can define at least a portion of the access opening 15, such that the shroud 29 can at least partially encircle the access opening 15, or the shroud 29 can be located above the access opening 15. The shroud 29 can curve downwards toward the treating chamber 32 to direct laundry items into the basket 30. The shroud 29 can overlie a portion of the basket 30 such that the laundry items do not fall between the basket 30 and the tub 34. A selectively openable lid 28 can be movably and hingedly mounted to the cabinet 14 for selective movement between an opened position and a closed position to selectively open and close the access opening 15 and provide access into the laundry treating chamber 32 through the access opening 15 of the basket 30.

A laundry mover 38 can be rotatably mounted within the basket 30 to impart mechanical agitation to a load of laundry placed in the basket 30. The laundry mover 38 can be oscillated or rotated about its vertical axis of rotation during a cycle of operation in order to produce load motion effective to wash the load contained within the treating chamber 32. Other exemplary types of laundry movers include, but are not limited to, an agitator, a wobble plate, and a hybrid impeller/agitator.

The basket 30 and the laundry mover 38 can be driven by a drive system 40 that includes a motor 41, which can include a gear case, operably coupled with the basket 30 and laundry mover 38. The motor 41 can rotate the basket 30 at various speeds in either rotational direction about the vertical axis of rotation, including at a spin speed wherein a centrifugal force at the inner surface of the basket side wall 18 is 1 g or greater. Spin speeds are commonly known for use in extracting liquid from the laundry items in the basket 30, such as after a wash or rinse step in a treating cycle of operation. A loss motion device or clutch (not shown) can be included in the drive system 40 and can selectively operably couple the motor 41 with either the basket 30 and/or the laundry mover 38.

A suspension system 22 can dynamically hold the tub 34 within the cabinet 14. The suspension system 22 can dissipate a determined degree of vibratory energy generated by the rotation of the basket 30 and/or the laundry mover 38 during a treating cycle of operation. Together, the tub 34, the basket 30, and any contents of the basket 30, such as liquid and laundry items, define a suspended mass for the suspension system 22.

A liquid supply system can be provided to liquid, such as water or a combination of water and one or more wash aids, such as detergent, into the treating chamber 32. The liquid supply system can include a water supply 44 configured to supply hot or cold water. The water supply 44 can include a hot water inlet 45 and a cold water inlet 46. A valve assembly can include a hot water valve 48, a cold water valve 50, and a diverter valve 55, and various conduits 52, 56, 58 for selectively distributing the water supply 44 from the hot water and cold water inlets 45, 46. The valves 48, 50 are selectively openable to provide water, such as from a household water supply (not shown) to the conduit 52. The valves 48, 50 can be opened individually or together to provide a mix of hot and cold water at a selected temperature. While the valves 48, 50 and conduit 52 are illustrated exteriorly of the cabinet 14, it will be understood that these components can be internal to the cabinet 14.

A dispensing system 53 can be provided for dispensing treating chemistry to the basket 30, either directly or mixed with water from the water supply 44. The dispensing system 53 can include a dispenser 54, which can be a single use dispenser, a bulk dispenser, or a combination of a single use and bulk dispenser in non-limiting examples, and is fluidly coupled to the treating chamber 32. As illustrated, the dispenser 54 can be fluidly coupled with the conduit 52 through a diverter valve 55 and a first water conduit 56. The dispensing system 53 can include means for supplying or mixing detergent to or with water from the first water conduit 56. Alternatively, water from the first water conduit 56 can also be supplied to the tub 34 through the detergent dispenser 54 without the addition of a detergent. A second water conduit, illustrated as the water inlet 58, can also be fluidly coupled with the conduit 52 through the diverter valve 55 such that water can be supplied directly to the treating chamber through the open top of the basket 30. Either or both of the dispenser 54 or the water inlet 58 can be configured to dispense the treating chemistry or water into the tub 34 in a desired pattern and under a desired amount of pressure. For example, either or both of the dispenser 54 or the water inlet 58 can be configured to dispense a flow or stream of treating chemistry or water into the tub 34 by gravity, i.e. a non-pressurized stream.

The treating chemistry dispenser 54 can include multiple chambers or reservoirs fluidly coupled to the treating chamber 32 for receiving doses of different treating chemistries. The treating chemistry dispenser 54 can be implemented as a dispensing drawer that is slidably received within the cabinet 14, or within a separate dispenser housing which can be provided in the cabinet 14. The treating chemistry dispenser 54 can be moveable between a fill position, where the treating chemistry dispenser 54 is exterior to the cabinet 14 and can be filled with treating chemistry, and a dispense position, where the treating chemistry dispenser 54 is interior of the cabinet 14.

Non-limiting examples of treating chemistries that can be dispensed by the dispensing system during a cycle of operation include one or more of the following: water, detergents, surfactants, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof. The treating chemistries can be in the form of a liquid, powder, or any other suitable phase or state of matter.

Additionally, the liquid supply system and dispensing system 53 can differ from the configuration shown, such as by inclusion of other valves, conduits, wash aid dispensers, heaters, sensors, such as water level sensors and temperature sensors, and the like, to control the flow of treating liquid through the washing machine 10 and for the introduction of more than one type of detergent/wash aid.

A liquid recirculation system can be provided for recirculating liquid from the tub 34 into the treating chamber 32. More specifically, the sump 60 can be located in the bottom of the tub 34 and the liquid recirculation system can be configured to recirculate treating liquid from the sump 60 onto the top of a laundry load located in the treating chamber 32. A pump 62 can be housed below the tub 34 and can have an inlet fluidly coupled with the sump 60 and an outlet configured to fluidly couple to either or both a household drain 64 or a recirculation conduit 66. In this configuration, the pump 62 can be used to drain or recirculate wash water in the sump 60. As illustrated, the recirculation conduit 66 can be fluidly coupled with the treating chamber 32 such that it supplies liquid into the open top of the basket 30. The liquid recirculation system can include other types of recirculation systems.

It is noted that the illustrated drive system, suspension system, liquid supply system, recirculation and drain system are shown for exemplary purposes only and are not limited to the systems shown in the drawings and described above. For example, the liquid supply, recirculation and pump systems can differ from the configuration shown in FIG. 1, such as by inclusion of other valves, conduits, sensors (such as liquid level sensors and temperature sensors), and the like, to control the flow of liquid through the washing machine 10 and for the introduction of more than one type of treating chemistry. For example, the liquid supply system can be configured to supply liquid into the interior of the tub 34 not occupied by the basket 30 such that liquid can be supplied directly to the tub 34 without having to travel through the basket 30. In another example, the liquid supply system can include a single valve for controlling the flow of water from the household water source. In another example, the recirculation and pump system can include two separate pumps for recirculation and draining, instead of the single pump as previously described.

The washing machine 10 can also be provided with a heating system (not shown) to heat liquid provided to the treating chamber 32. In one example, the heating system can include a heating element provided in the sump to heat liquid that collects in the sump 60. Alternatively, the heating system can be in the form of an in-line heater that heats the liquid as it flows through the liquid supply, dispensing and/or recirculation systems.

The washing machine 10 can further include a control system, illustrated herein as a controller 70, coupled with various working components of the washing machine 10 to control the operation of the working components and to implement one or more treating cycles of operation. A user interface 26 can be operably coupled with the controller 70. The user interface 26 can provide an input and output function for the controller 70. The user interface 26 can include one or more knobs, dials, switches, displays, touch screens and the like for communicating with the user, such as to receive input and provide output. For example, the displays can include any suitable communication technology including that of a liquid crystal display (LCD), a light-emitting diode (LED) array, or any suitable display that can convey a message to the user. The user can enter different types of information including, without limitation, cycle selection and cycle parameters, such as cycle options. Other communications paths and methods can also be included in the washing machine 10 and can allow the controller 70 to communicate with the user in a variety of ways. For example, the controller 70 can be configured to receive input from and provide output to the user either through the washing machine 10, the user interface 26, or utilizing another device, such as an app for a mobile phone or other electronic device. Non-limiting examples of such input and output can include sending a text message to the user, sending an electronic mail to the user, providing audio information to the user, or receiving control instructions from a user through an app, text message, electronic mail, or audio input.

The controller 70 can include the machine controller and any additional controllers provided for controlling any of the components of the washing machine 10. For example, the controller 70 can include the machine controller and a motor controller. Many known types of controllers can be used for the controller 70. It is contemplated that the controller is a microprocessor-based controller that implements control software and sends/receives one or more electrical signals to/from each of the various working components to implement the control software. As an example, proportional control (P), proportional integral control (PI), and proportional derivative control (PD), or a combination thereof, a proportional integral derivative control (PID), can be used to control the various components of the washing machine 10.

Figure 2:
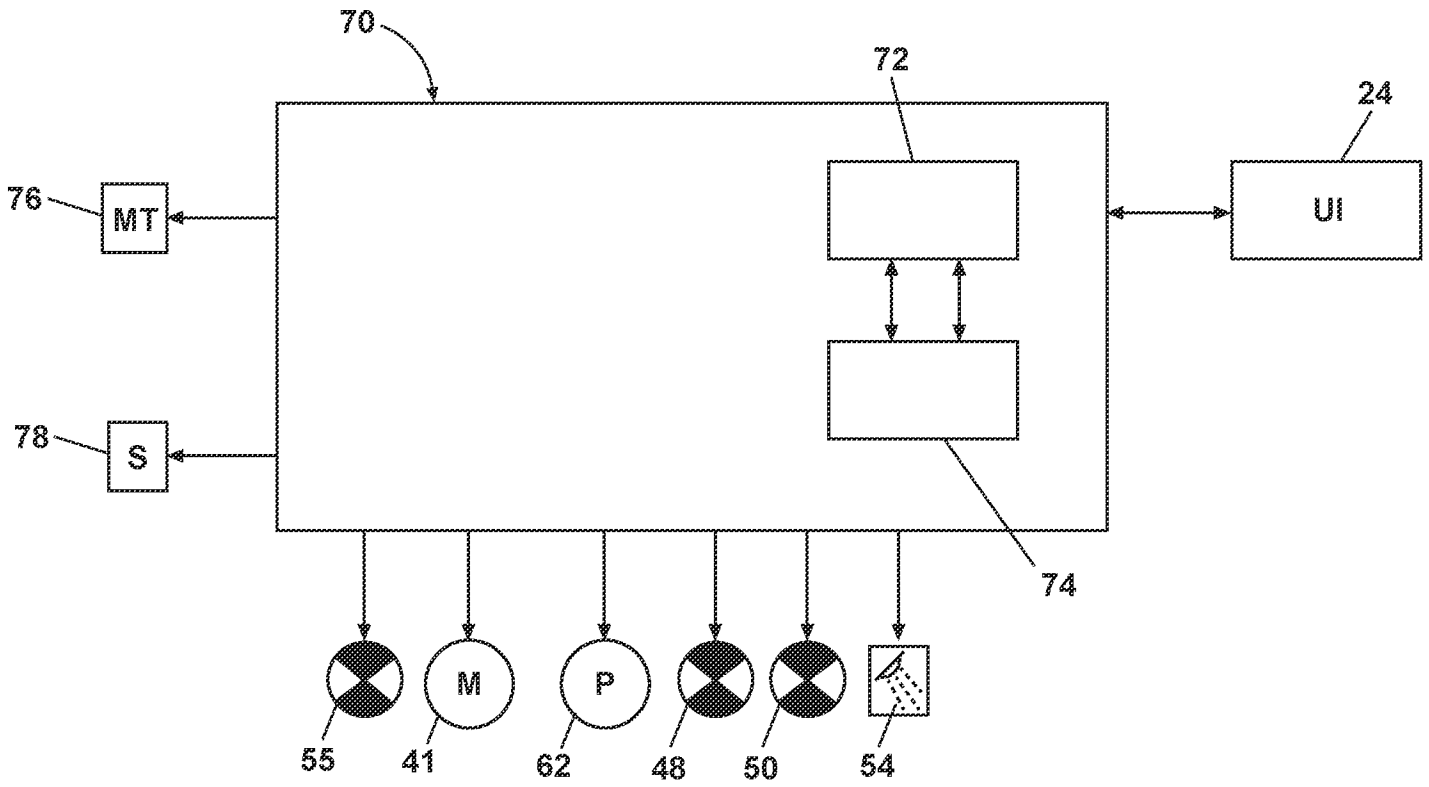
FIG. 2 is a schematic representation of a control system for controlling the operation of the laundry treating appliance of FIG. 1.

As illustrated in FIG. 2, the controller 70 can be provided with a memory 72 and a central processing unit (CPU) 74. The memory 72 can be used for storing the control software that can be executed by the CPU 74 in completing a cycle of operation using the washing machine 10 and any additional software. For example, the memory 72 can store a set of executable instructions including at least one user-selectable cycle of operation. Examples, without limitation, of treating cycles of operation include: wash, heavy-duty wash, delicate wash, quick wash, pre-wash, refresh, rinse only, and timed wash, which can be selected at the user interface 26. The memory 72 can also be used to store information, such as a database or table, and to store data received from the one or more components of the washing machine 10 that can be communicably coupled with the controller 70. The database or table can be used to store the various operating parameters for the one or more cycles of operation, including factory default values for the operating parameters and any adjustments to them by the control system or by user input.

The controller 70 can be operably coupled with one or more components of the washing machine 10 for communicating with and/or controlling the operation of the components to complete a cycle of operation. For example, the controller 70 can be coupled with the hot water valve 48, the cold water valve 50, the diverter valve 55, and the dispenser 54 for controlling the temperature and flow rate of treating liquid into the treating chamber 32; the pump 62 for controlling the amount of treating liquid in the treating chamber 32 or sump 60; drive system 40 at the motor 41 for controlling the direction and speed of rotation of the basket 30 and/or the laundry mover 38; and the user interface 26 for receiving user selected inputs and communicating information to the user. The controller 70 can also receive input from a temperature sensor 76, such as a thermistor, which can detect the temperature of the treating liquid in the treating chamber 32 and/or the temperature of the treating liquid being supplied to the treating chamber 32. The controller 70 can also receive input from various additional sensors 78, which are known in the art and not shown for simplicity. Non-limiting examples of additional sensors 78 that can be communicably coupled with the controller 70 include a weight sensor, a moisture sensor, a chemical sensor, a position sensor, an imbalance sensor, a load size sensor, and a motor torque sensor, which can be used to determine a variety of system and laundry characteristics, such as laundry load inertia or mass.

Figure 3:
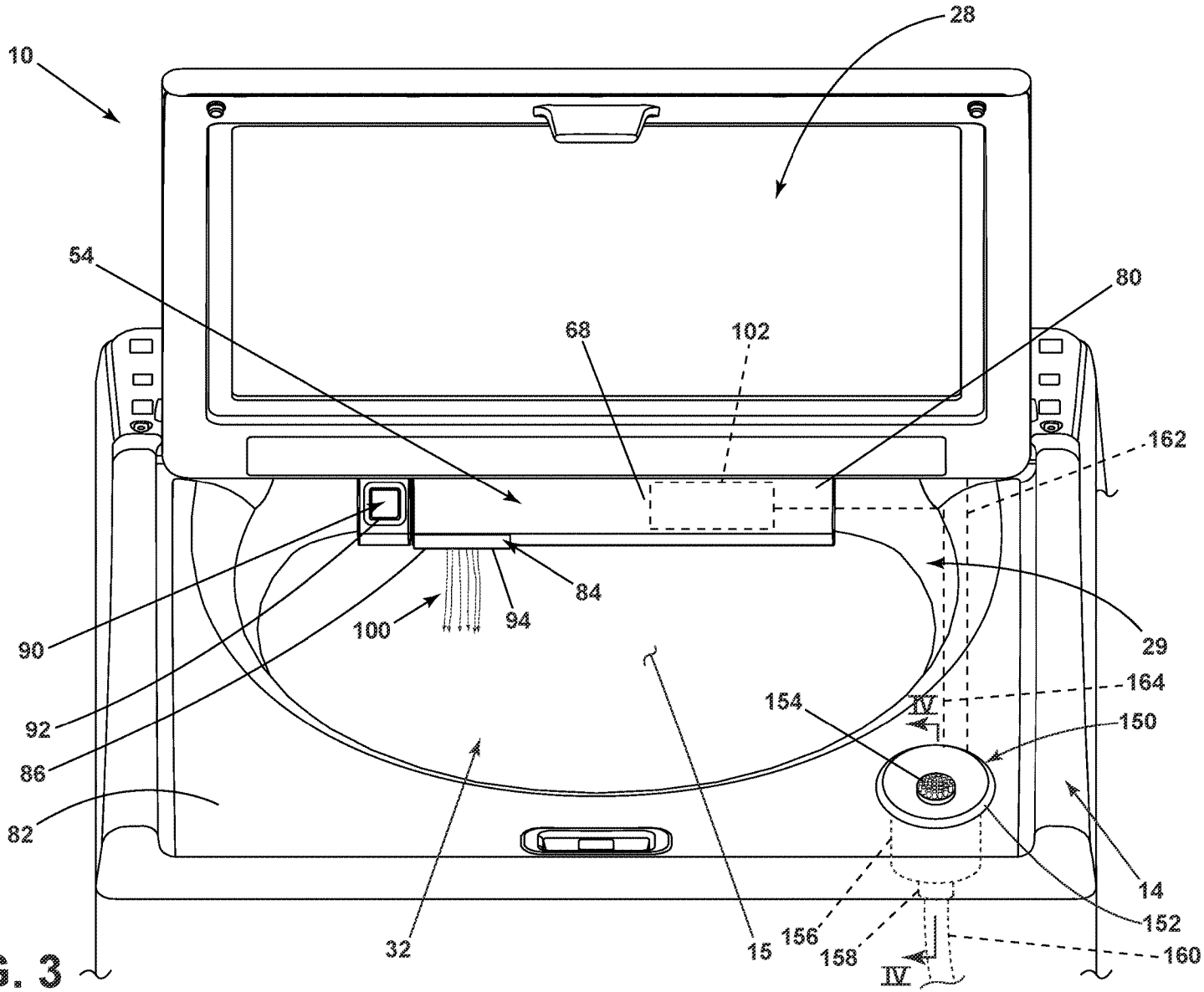
FIG. 3 is a top view of an opening in the laundry treating appliance of FIG. 1 having a dispenser and a stain treating station.

Looking now at the dispensing system 53 in greater detail, reference is made to FIG. 3, which illustrates a top view of the washing machine 10 showing the dispensing system 53, which can have a pre-treatment faucet 84. For ease of viewing, the lid 28 is shown in the opened position to illustrate the relative positions of the dispenser 54, shroud 29 and access opening 15. More specifically, the dispenser 54 can be provided in (and can partially form) the shroud 29 toward the rear of the access opening 15, though any other suitable position of the dispenser 54 is contemplated. The dispenser 54 can include a drawer 80 movable or slidable between a closed, first position and an opened, second position (not shown) relative to the shroud 29. The drawer 80 of the dispenser 54 can further include a front panel 68, which forms a portion of the shroud 29 in the closed, first position. The drawer 80 of the dispenser 54 can further define at least one bulk treating reservoir 102 configured to store a bulk quantity of a treating chemistry. The bulk treating reservoir 102 is fluidly coupled to the treating chamber 32.

The faucet 84 can be provided on the drawer 80. The faucet 84 can underlie the shroud 29 when the drawer 80 is in the closed, first position. The faucet 84 can have an outlet 86 provided in the front panel 68 of the dispenser 54. The outlet 86 can be formed as an aperture 94 in the drawer 80 or the shroud 29. A pre-treatment water flow, or supply of water 100, can be provided from the faucet 84 at the outlet 86, and dispensed to the treating chamber 32 through the access opening 15. In particular, the supply of water 100 can be provided from the dispenser 54 at the faucet 84. When the drawer 80 is in the first position the supply of water 100 can be directed in a stream flowing out of the outlet 86 in the faucet 84 and toward the treating chamber 32 in a downward direction. However, it will be understood that the position of the drawer 80, whether closed or opened, does not limit the function of the faucet 84 and that the supply of water 100 can be directed in a stream flowing out of the outlet 86 in the faucet 84 and toward the treating chamber 32 in a downward direction regardless of the position of the drawer 80.

An actuator 90 can operably couple to the dispenser 54 to control the supply of water 100 from the faucet 84. A user can operate the actuator 90 to utilize the faucet 84 for pre-treatment of laundry items. In this illustrative example, the actuator 90 is in the form of a switch 92. However, the actuator 90 can be any suitable actuatable element, such as a switch, button, dial, or knob. The actuator 90 can be provided on the shroud 29 or the dispenser 54, such that the actuator 90 is accessible through the access opening 15 while the lid 28 is in the opened position. While the actuator 90 is shown as being located on the shroud 29, the actuator 90 can be located on any other suitable location accessible by a user, such as on the cabinet 14, drawer 80, or user interface 26. The actuator 90 can be a mechanical actuator wherein the supply of water 100 is controlled by way of a mechanical operation, or the actuator 90 can be an electrical actuator wherein the supply of water 100 is controlled by way of an electric signal or current. Alternatively, it is contemplated that any suitable operable control mechanism be used to control the supply of water 100.

A stain treating station 150 can be carried by the cabinet 14 and can be provided at a location spaced from the drawer 80 of the dispenser 54. The stain treating station 150 can be defined by a recess in the top wall 82 of the cabinet 14. However, while the stain treating station 150 is illustrated herein as being located in the top wall 82, it will be understood that the stain treating station 150 can also be located in any other suitable location within the washing machine 10, a non-limiting example of which includes in the shroud 29. Regardless of whether the stain treating station 150 is located in the top wall 82 or in the shroud 29, it will be understood that the stain treating station 150 can be positioned such that the lid 28 overlies the stain treating station 150 when the lid 28 closes the access opening 15. In one aspect of the disclosure, the dispenser 54 can be located along a rear portion of the shroud 29 while the stain treating station 150 is located along a front of the shroud 29 or the cabinet 14.

The stain treating station 150 can include a drain outlet 158, which can fluidly couple the stain treating station 150 to the treating chamber 32. The fluid connection between the drain outlet 158 and the treating chamber 32 can be formed by positioning the drain outlet 158 to overlie the treating chamber 32, or by the inclusion of a drain conduit 160 to fluidly couple the drain outlet 158 to the treating chamber 32. It will also be understood that, either alternately or in addition, the stain treating station 150 can be fluidly coupled to the pump 62 via the drain outlet 158 and/or the drain conduit 160. A stain treating station supply conduit 162 can be provided to fluidly couple the stain treating station 150 to the water supply 44, such that water is supplied by the water supply 44 to the stain treating station 150. A treating chemistry conduit 164 can be provided to fluidly couple the stain treating station 150 to the bulk treating reservoir 102, such that treating chemistry can be supplied from the bulk treating reservoir 102 to the stain treating station 150. By the provision of these fluid connections, water that is supplied via the stain treating station supply conduit 162 and treating chemistry that is supplied by the treating chemistry conduit 164 to the stain treating station 150 can be eventually provided to the treating chamber 32 via the drain outlet 158.

Figure 4:
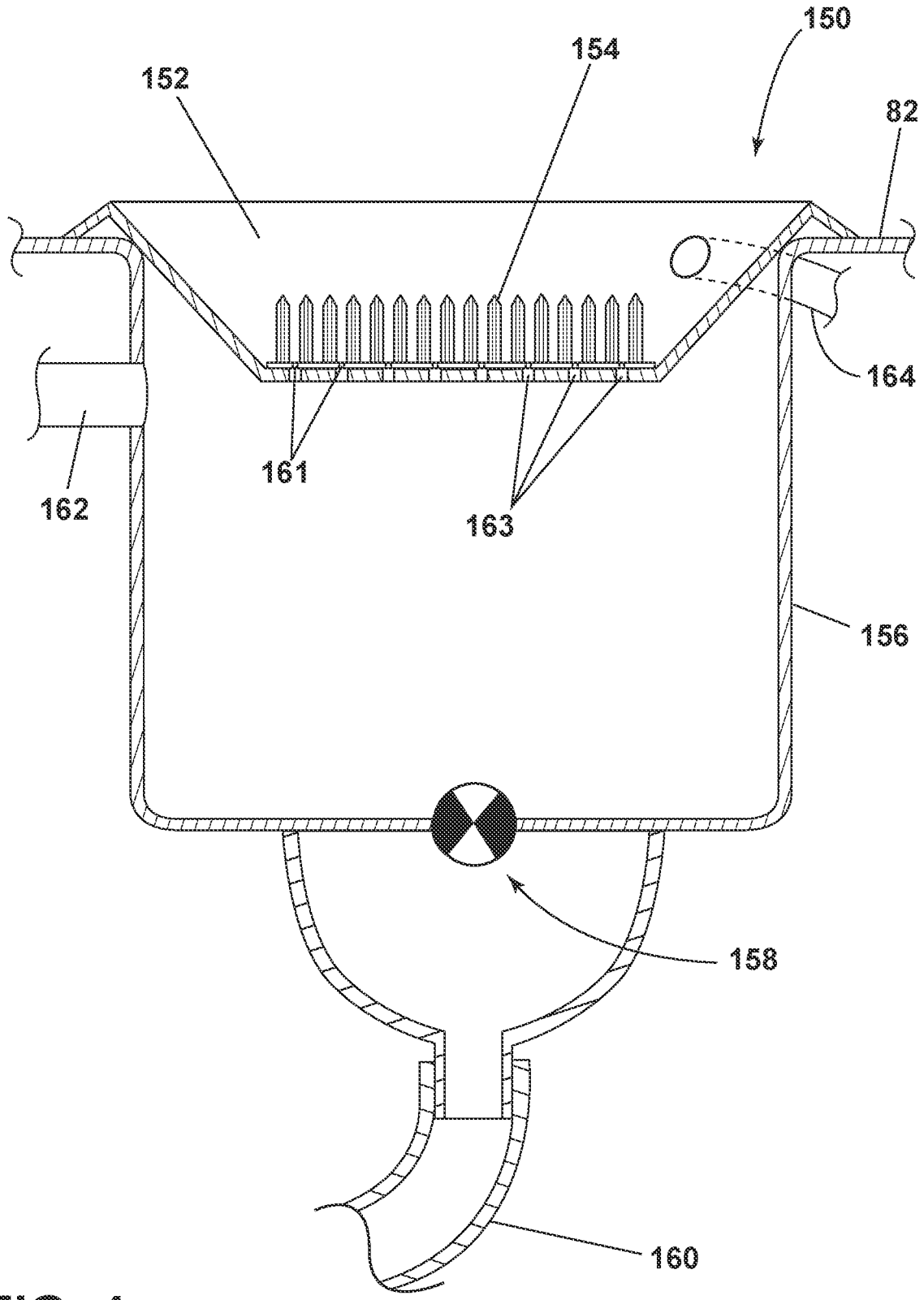
FIG. 4 is a cross-sectional view taken along line IV-IV of FIG. 3 of the stain treating station.

Turning now to FIG. 4, a cross-sectional view showing the details of the structure of the stain treating station 150 can be seen. The stain treating station 150 comprises a treatment basin 152, a scrubbing surface 154, and a treatment reservoir 156. The treatment basin 152 can have a shape that is sloped downwardly from the top wall 82 or the shroud 29 towards the center of the treatment basin 152 and the scrubbing surface 154. The scrubbing surface 154 can cooperate with the treatment basin 152 such that the scrubbing surface 154 overlies or resides within the treatment basin 152. In one aspect, the scrubbing surface 154 can be positioned within the treatment basin 152 such that the treatment basin 152 defines a shape that slopes downwardly toward the scrubbing surface 154. While the treatment basin 152 and scrubbing surface 154 are illustrated herein as having a substantially circular shape, it will be understand that any suitable shape can be provided, non-limiting examples of which include oval, square, rectangular, etc.

The scrubbing surface 154 can include a textured area for supporting material being pretreated. In one aspect of the disclosure, the scrubbing surface 154 can comprise a set of bristles that can extend upwardly from the scrubbing surface 154. The scrubbing surface 154 can be configured to allow for the passing of excess pretreating liquid through the scrubbing surface during use. For example, the scrubbing surface 154 can include grooves, channels, or perforations 161 through which the pretreating liquid can drain out. Such perforations 161 can comprise a plurality of small holes, openings, apertures, thin slots, or the like, in any desired arrangement that are fluidly coupled to the treatment basin 152. The scrubbing surface 154 and draining perforations 161 can be arranged to drain the excess pretreating liquid into the treatment basin 152, where the liquid can be further drained to the treatment reservoir 156 and into the treating chamber 32 via the drain outlet 158. The scrubbing surface 154 can also comprise perforated material such as mesh or polymeric materials, or other material that is conducive to allowing a liquid to pass through. The perforated material or mesh can be made of plastic, metal or other suitable material.

The treatment reservoir 156 can be located beneath the treatment basin 152 and scrubbing surface 154, below the top wall 82 or the shroud 29. The treatment reservoir 156 can comprise the drain outlet 158 which thus also fluidly couples the treatment basin 152 to the treating chamber 32. Either the treatment basin 152 or the scrubbing surface 154, or both, can have at least one draining opening 163 to fluidly couple the treatment basin 152 to the drain outlet 158 and to allow residual liquid in the treatment basin 152 to drain into the treating chamber 32, the tub 34, or the basket 30. The at least one draining opening 163 can be provided as an aperture or opening in the treatment basin 152 that is always open to allow fluid communication between the treatment basin 152 and the treatment reservoir 156, or the draining opening 163 can comprise a selectively openable draining opening 163 that can be mechanically or electrically actuated to allow liquid to drain from the treatment basin 152 to the treatment reservoir 156. The drain outlet 158 can be easily fluidly coupled to the treating chamber 32 via the drain conduit 160 as the drain outlet 158 and drain conduit 160 can be positioned over and above the treating chamber 32, thereby allowing excess liquid to gravity feed directly into the treating chamber 32. Thus, the stain treating station 150 can be configured to act as a reservoir for dispensing detergent, softener, or other fabric treating liquid during a wash cycle.

Further, it will be understood that the drain outlet 158 can be provided as an opening in the treatment reservoir 156 that constantly allows liquid present in the treatment reservoir 156 to drain to the drain conduit 160, or the drain outlet 158 can comprise a selectively openable valve such that the treatment reservoir 156 is only allowed to be opened and drain liquid to the drain conduit 160 when the valve is actuated in accordance with, for example, input from the controller 70 or user actuation via the actuator 90 or any other suitable actuator.

The stain treating station supply conduit 162 can be coupled to the water supply 44 of the washing machine 10 at a variety of suitable points in the liquid supply circuit to provide water to the stain treating station 150, non-limiting examples of which include to the first water conduit 56, to the water inlet 58, directly to the diverter valve 55, or from the dispenser 54. The stain treating station supply conduit 162 can further be coupled to the stain treating station 150 at, by way of non-limiting example, the treatment basin 152 or the treatment reservoir 156. The supply of water through the stain treating station supply conduit 162 can be configured to provide water for the scrubbing of laundry items and also to assist in cleaning the treatment reservoir 156 and rinsing out any treating chemistry that may remain in the treatment basin 152 or the treatment reservoir 156.

The bulk treating reservoir 102 can be fluidly coupled to the treatment basin 152 of the stain treating station 150 via the treating chemistry conduit 164, although it will also be understood that the treating chemistry conduit 164 can be coupled to the treatment reservoir 156 instead of the treatment basin 152. The treating chemistry conduit 164 can be configured to deliver treating chemistry that is stored within the bulk treating reservoir 102 to the stain treating station 150 to aid in pretreatment of stains on laundry items by a user. In the case where treating chemistry is supplied from the treating chemistry conduit 164 to the treatment reservoir 156, the stain treating station 150 can include a mechanism for delivering the treating chemistry upwardly from the treatment reservoir 156 through the scrubbing surface 154. The mechanism for actuating the upward delivery of the treating chemistry through the scrubbing surface 154 can be any suitable actuating mechanism such that a user can press against the scrubbing surface 154 to cause the liquid to be drawn upwardly through the scrubbing surface 154, similar to the action of a conventional soap dispenser, where a downward pressure on an actuator causes the liquid to be drawn up through the actuator.

In one aspect of the disclosure, treating chemistry can be supplied to the stain treating station 150 via the treating chemistry conduit 164 alone in order to provide concentrated treating chemistry for pre-treating, or water can be supplied via the stain treating station supply conduit 162 at the same time as the treating chemistry is provided via the treating chemistry conduit 164 to provide a mix of treating chemistry and water for pre-treating.

The provision of water through the stain treating station supply conduit 162 and the provision of treating chemistry through the treating chemistry conduit 164 can be controlled by a user by the actuator 90, or a separate actuator (not shown) can be provided that is dedicated to the functions of the stain treating station 150. It is also contemplated that activation of the provision of water through the stain treating station supply conduit 162 or the provision of treating chemistry through the treating chemistry conduit 164 can be controlled by a user input to the user interface 26. User interaction with the actuator 90 can result in the actuation of a diverter valve or a metering pump to allow water or treating chemistry to flow to the stain treating station 150.

A user could also select via the actuator 90 if the water to be supplied to the stain treating station 150 would be hot water, cold water, or a mix of cold and hot water. When warm or hot water is desired to be provided to the stain treating station 150, it is contemplated that a heating element (not shown) can be provided adjacent the stain treating station supply conduit 162 in order to heat the water being provided to the stain treating station 150. Alternately, the stain treating station 150 can be coupled to the water supply 44, including directly or indirectly to the hot water inlet 45 or the cold water inlet 46. In such a case, the water supply 44 can be fluidly coupled either to the stain treating station 150 or to the stain treating station supply conduit 162.

Figure 5:
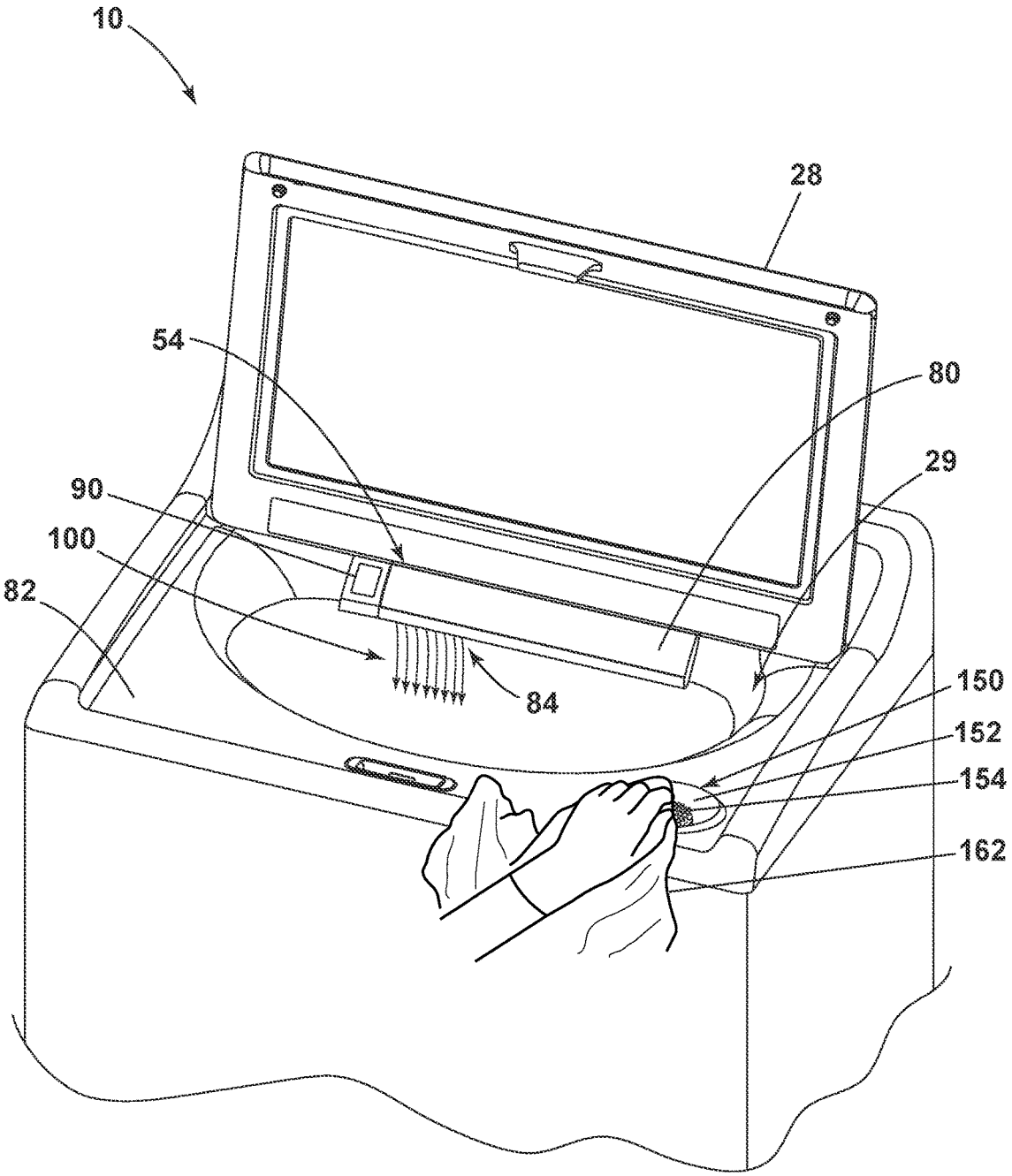
FIG. 5 is a perspective view depicting exemplary use of the stain treating station.

FIG. 5 illustrates the stain treating station 150 in use by a user. In use, a laundry item can be treated by the user, such as by rubbing or brushing a stain on the laundry item within the stain treating station 150. By providing the scrubbing surface 154 within the treatment basin 152, the stain treating station 150 allows for a user to have full access to the scrubbing surface 154 and to move the laundry item against the scrubbing surface 154 at any desired angle of approach. Optionally, the faucet 84 can be used to treat a laundry item prior to the washing machine 10 running an automatic cycle of operation. The laundry item can be placed underneath the faucet 84 in the trajectory of the supply of water 100 flowing out of the outlet 86. The user can actuate the actuator 90 to start the supply of water 100 from the faucet 84. The laundry item can be at least partially saturated with the supply of water 100. The wet laundry treating item can be treated by the user, such as rubbing or brushing a stain on the wet laundry item against the scrubbing surface 154. In another example, before or after the laundry item is wetted using the faucet 84, a treating chemistry such as a stain-remover or other treating chemistry can be applied to the laundry item via the stain treating station 150. The user can then treat the laundry item with the stain-remover having been wet by the water supplied from the faucet 84.

Figure 6:
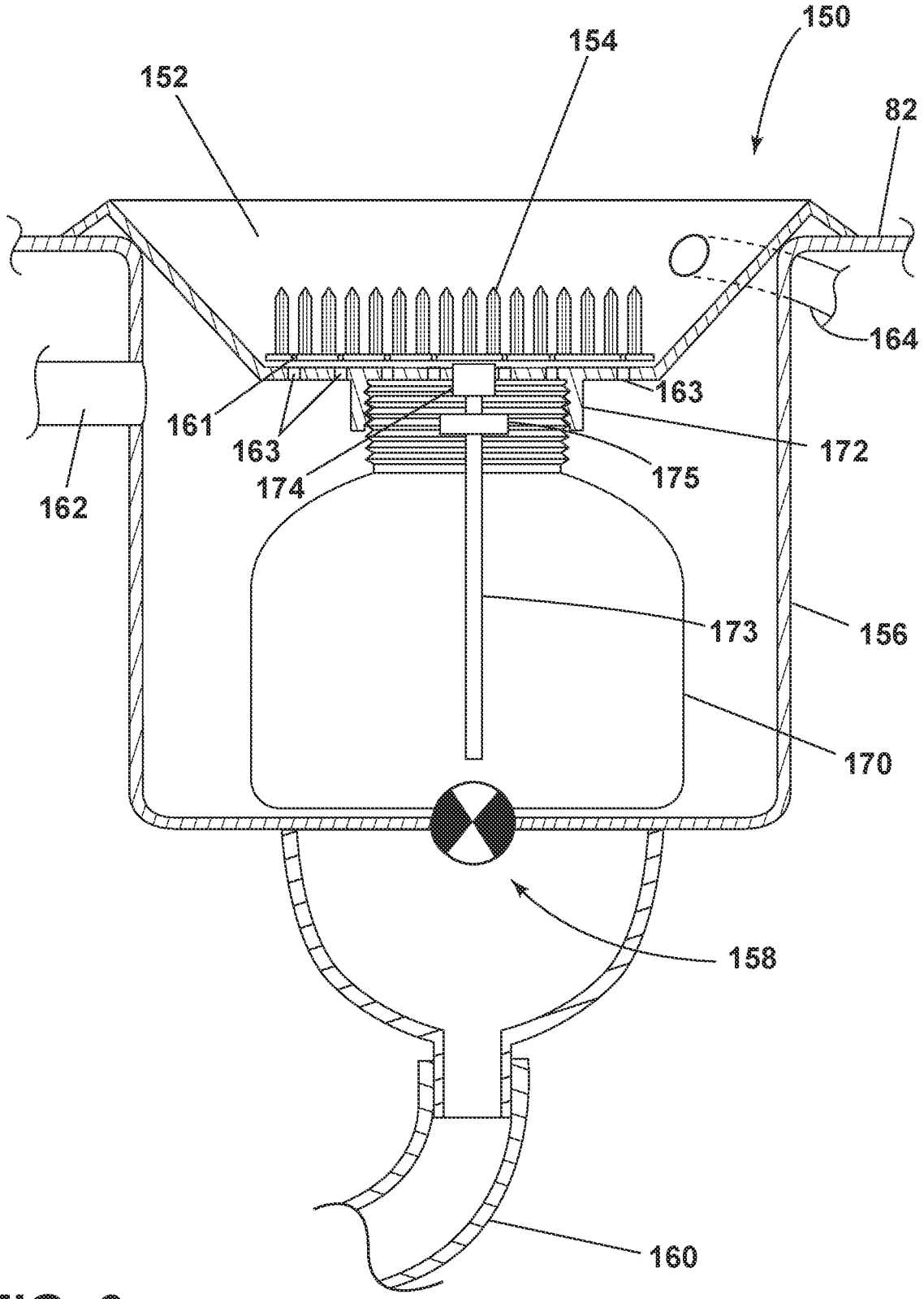
FIG. 6 is a cross-sectional view taken along line IV-IV of FIG. 3 of the stain treating station according to another aspect of the present disclosure.

FIG. 6 illustrates a cross-sectional view of the stain treating station 150 according to another aspect of the present disclosure. In this aspect, rather than having treating chemistry supplied to the stain treating station 150 from the bulk treating reservoir 102, a treating chemistry bottle 170 can be coupled to the stain treating station 150. In an exemplary aspect, the treatment basin 152 can further define a threaded portion 172 within which the treating chemistry bottle 170 can be threadably received. The treating chemistry bottle 170 can be refillable for multiple uses or can be a consumable item designed to be replaced when the contents are consumed. The treatment basin 152 and scrubbing surface 154 can be removably coupled to the top wall 82 or the shroud 29 to allow replacement or refilling of the treating chemistry bottle 170.

Treating chemistry can be drawn upwardly from the treating chemistry bottle 170 at least through the perforations 161 of the scrubbing surface 154 by the inclusion of a mechanism for mechanical actuation, such as when a user presses downwardly on the scrubbing surface 154. The mechanism for actuating the upward delivery of the treating chemistry from the treating chemistry bottle 170 positioned in the treatment reservoir 156 to the treatment basin 152, and optionally through the scrubbing surface 154, can be any suitable actuating mechanism, such as one similar to the action of a conventional soap dispenser, where a downward pressure on an actuator causes the liquid to be drawn up through the actuator. A non-limiting example of such a mechanism can include a mechanism wherein pressing downwardly on the scrubbing surface 154 mechanically actuates a plunger 174 to cause liquid to be drawn upwardly through a treatment conduit 173. Optionally, a pump 175 can be operably coupled to either of the treatment conduit 173 or the plunger 174 to aid in drawing the treating chemistry upwardly through the treatment conduit 173. The plunger 174 is illustrated herein as being fluidly coupled with the treatment conduit 173 and at least one of the treatment basin 152 or the scrubbing surface 154. However, it will be understood that the plunger 174 could be positioned at a different point underlying the scrubbing surface 154, but not directly coupled to the treatment conduit 173.

When the treating chemistry bottle 170 is placed or replaced within the treatment reservoir 156, complementary or keying structures can be provided either between the treating chemistry bottle 170 and the treatment reservoir 156, or between the treatment basin 152 and the top wall 82 or shroud 29 to prevent rotation of the stain treating station 150 relative to the cabinet 14. Use of the stain treating station 150 and draining of the treatment reservoir 156 can operate in the same way as previously described, only the source of the treating chemistry is changed from the first aspect of the disclosure.

The aspects of the present disclosure provide a stain treating station that obviates the need for an external sink or space for pre-washing or pre-treating laundry. Having the stain treating station fluidly coupled to both the water supply and to the bulk treating reservoir allows for user control for ideal stain treating conditions. For example, a user can select a desired temperature of water for pre-treatment, as well as choosing to either provide concentrated treating chemistry for stain treatment or to dilute the treating chemistry using the water supply. The provision of the scrubbing surface within the treatment basin contains any liquid or treating chemistry while also providing for the draining of the liquid or treating chemistry to the treating chamber. The aspects herein also minimize additional space otherwise required to route the supply of water to a stain treating station by providing the water from the dispenser that is already included within the washing machine. The aspects described herein also provide flexibility in that a user can use treating chemistry supplied from the bulk treating reservoir or from a consumable or refillable treating chemistry bottle coupled to the stain treating station.

To the extent not already described, the different features and structures of the various aspects of the present disclosure can be used in combination with each other as desired. That one feature may not be illustrated in all of the aspects of the disclosure is not meant to be construed that it cannot be, but is done for brevity of description. Thus, the various features of the different aspects of the present disclosure can be mixed and matched as desired to form new aspects, whether or not the new aspects are expressly described. All combinations or permutations of features described herein are covered by this disclosure.

While the present disclosure has been specifically described in connection with certain specific aspects thereof, it is to be understood that this is by way of illustration and not of limitation. Reasonable variation and modification are possible within the scope of the forgoing disclosure and drawings without departing from the spirit of the present disclosure which is defined in the appended claims. Hence, specific dimensions and other physical characteristics relating to the aspects of the present disclosure are not to be considered as limiting, unless expressly stated otherwise.

What is claimed is:

1. A laundry treating appliance, comprising:
- a chassis defining an interior;
- a treating chamber located within the interior and rotatable;
- a dispenser having at least one bulk treating reservoir fluidly coupled to the treating chamber;
- a stain treating station carried by the chassis at a location spaced from the dispenser, the stain treating station having a treatment basin; and
- a treating chemistry bottle removable from and selectively fluidly coupled to the stain treating station and wherein the treatment basin is overlying the treating chemistry bottle.

2. The laundry treating appliance of claim 1 wherein the treating chemistry bottle is a replaceable consumable bottle.

3. The laundry treating appliance of claim 1 wherein the treating chemistry bottle is fluidly coupled to the treatment basin.

4. The laundry treating appliance of claim 1 wherein the treatment basin comprises a threaded portion within which the treating chemistry bottle can be threadably received.

5. The laundry treating appliance of claim 3, further comprising an actuating mechanism for delivering treating chemistry from the treating chemistry bottle to the treatment basin.

6. The laundry treating appliance of claim 5 wherein the actuating mechanism further delivers the treating chemistry to a scrubbing surface.

7. The laundry treating appliance of claim 5 wherein the actuating mechanism comprises a plunger for drawing treating chemistry upwardly through a treatment conduit to the treatment basin.

8. The laundry treating appliance of claim 1, further comprising a water supply fluidly coupled to both the dispenser and the stain treating station.

9. The laundry treating appliance of claim 1 wherein the treatment basin comprises a drain fluidly coupled to the treating chamber.

10. The laundry treating appliance of claim 1 wherein the chassis includes a top wall and the stain treating station is located in the top wall.

11. The laundry treating appliance of claim 1 wherein the chassis comprises a shroud having an opening providing access to the treating chamber and the stain treating station is located in the shroud.

12. The laundry treating appliance of claim 11 wherein the dispenser is located along a rear of the shroud and the stain treating station is located along a front of the shroud.

13. The laundry treating appliance of claim 11, further comprising a lid movably mounted to the chassis to selectively open/close the opening wherein the lid overlies the stain treating station when the lid closes the opening.

14. The laundry treating appliance of claim 1 wherein the stain treating station comprises a scrubbing surface and the scrubbing surface overlies the treating chemistry bottle.

15. The laundry treating appliance of claim 14 wherein the treatment basin cooperates with the scrubbing surface, the scrubbing surface overlying or residing within the treatment basin.

16. A laundry treating appliance, comprising:
- a chassis defining an interior;
- a rotatable treating chamber located within the interior;
- a dispenser having at least one bulk treating reservoir fluidly coupled to the rotatable treating chamber;
- a stain treating station carried by the chassis at a location spaced from the dispenser, the stain treating station including a threaded portion; and
- a treating chemistry bottle threadably receivable within the threaded portion and when the treating chemistry bottle is threadably received the treating chemistry bottle is fluidly coupled to the stain treating station; and
- wherein the stain treating station comprises a treatment basin overlying the treating chemistry bottle.

17. A laundry treating appliance, comprising:
- a chassis defining an interior;
- a rotatable treating chamber located within the interior and rotatable about a generally vertical axis and having an access opening;
- a shroud connected to the chassis and located above the access opening;
- a dispenser located in the shroud and fluidly coupled to the rotatable treating chamber;
- a stain treating station located in the shroud along a front of the chassis and spaced from the dispenser, the stain treating station including a treatment basin;
- a treating chemistry bottle removably couplable to a portion of the stain treating station and when the treating chemistry bottle is coupled to the portion of the stain treating station the treating chemistry bottle is fluidly coupled to the stain treating station; and
- a lid hingedly mounted to the chassis for movement between an opened and closed position, with the lid overlying the stain treating station in the closed position; and
- wherein the treatment basin is fluidly coupled to and overlying the treating chemistry bottle.

18. The laundry treating appliance of claim 17 wherein the stain treating station comprises a scrubbing surface overlying the treatment basin, the scrubbing surface comprising openings fluidly coupled to the treatment basin.

* * * * *